US009526276B2

(12) United States Patent
Lambertz

(10) Patent No.: US 9,526,276 B2
(45) Date of Patent: Dec. 27, 2016

(54) PROTECTIVE ELEMENT FOR CYCLIST PANTS

(75) Inventor: Bodo W. Lambertz, Pfaffikon (CH)

(73) Assignee: X-Technology Swiss GmbH, Wollerau (CH)

( * ) Notice: Subject to any disclaimer, the term of this patent is extended or adjusted under 35 U.S.C. 154(b) by 1335 days.

(21) Appl. No.: 12/737,853

(22) PCT Filed: Sep. 3, 2009

(86) PCT No.: PCT/EP2009/006395

§ 371 (c)(1),
(2), (4) Date: Sep. 21, 2011

(87) PCT Pub. No.: WO2010/025920

PCT Pub. Date: Mar. 11, 2010

(65) Prior Publication Data

US 2012/0005813 A1 Jan. 12, 2012

(30) Foreign Application Priority Data

Sep. 4, 2008 (DE) ..... 20 2008 011 774 U

(51) Int. Cl.
*A41D 1/08* (2006.01)

(52) U.S. Cl.
CPC ..... *A41D 1/084* (2013.01)

(58) Field of Classification Search
CPC ... A41D 1/084; A41D 13/058; A41D 13/0537
USPC ..... 2/227, 228, 466, 446
See application file for complete search history.

(56) References Cited

U.S. PATENT DOCUMENTS

| | | | | | |
|---|---|---|---|---|---|
| 2,292,318 | A * | 8/1942 | Daly | 36/3 B |
| 2,451,929 | A * | 10/1948 | Dorgin | 36/44 |
| 3,508,550 | A * | 4/1970 | Vollrath | 604/394 |
| 3,909,847 | A * | 10/1975 | Holt et al. | 2/465 |
| 4,709,490 | A * | 12/1987 | Fottinger et al. | 36/44 |
| 4,945,571 | A * | 8/1990 | Calvert | 2/467 |
| 5,261,169 | A * | 11/1993 | Williford | 36/43 |
| 5,271,101 | A * | 12/1993 | Speth et al. | 2/228 |
| 5,274,846 | A * | 1/1994 | Kolsky | 2/460 |
| 5,388,349 | A * | 2/1995 | Ogden | 36/43 |
| 5,423,087 | A * | 6/1995 | Krent et al. | 2/463 |
| 6,083,857 | A * | 7/2000 | Bottger et al. | 442/370 |
| 6,092,305 | A * | 7/2000 | Troy et al. | 36/3 B |
| 6,093,468 | A * | 7/2000 | Toms et al. | 428/67 |
| 6,393,618 | B2 * | 5/2002 | Garneau | 2/228 |
| 6,565,702 | B1 * | 5/2003 | Forsyth et al. | 156/308.4 |
| 6,845,519 | B2 * | 1/2005 | Garneau | 2/161.1 |
| 6,928,665 | B1 * | 8/2005 | Yates | 2/466 |
| 6,990,752 | B2 * | 1/2006 | Garneau | 36/3 R |
| 7,047,667 | B2 * | 5/2006 | Klavano | 36/3 R |
| 7,578,006 | B2 * | 8/2009 | Garneau | 2/161.1 |
| 7,707,659 | B2 * | 5/2010 | Africa et al. | 2/267 |
| 7,739,754 | B2 * | 6/2010 | Garneau | 2/466 |
| 8,042,197 | B2 * | 10/2011 | Maier | 2/228 |
| 8,087,097 | B2 * | 1/2012 | Maier | 2/227 |
| 8,298,648 | B2 * | 10/2012 | Turner et al. | 428/138 |

(Continued)

*Primary Examiner* — Richale Quinn
(74) *Attorney, Agent, or Firm* — Olson & Cepuritis, Ltd.

(57) ABSTRACT

The invention relates to a protective element for cyclist pants, having a front protective region (1) and a rear protective region (2), which are connected to each other by a tapering (3). The protective regions (1, 2) and the tapering (3) each comprise a surface (10) having a three-dimensional structure.

6 Claims, 7 Drawing Sheets

(56) References Cited

U.S. PATENT DOCUMENTS

Figure 1:
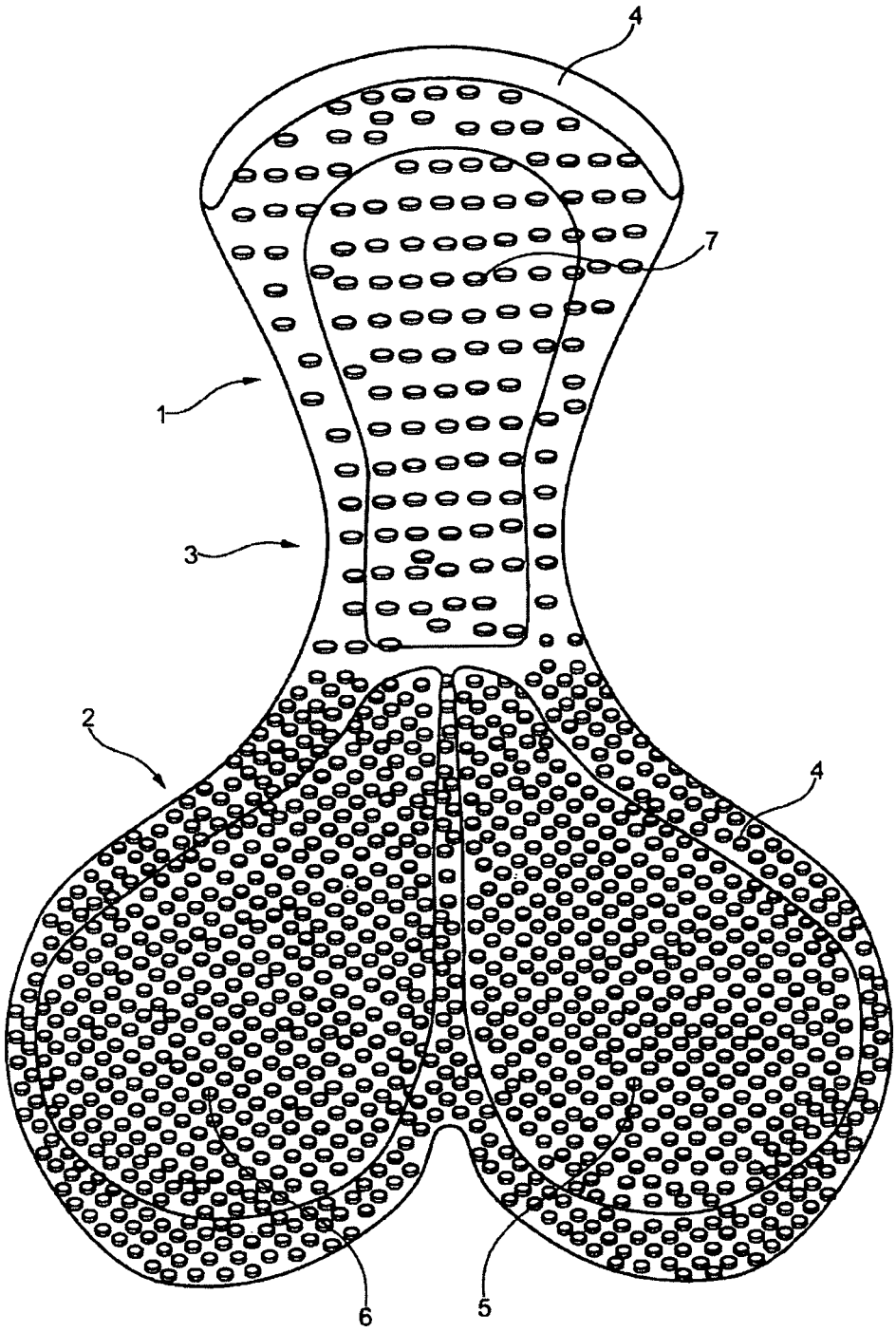

| | | | | |
|---|---|---|---|---|
| 8,713,816 | B2 * | 5/2014 | Al-Sabah | 36/3 B |
| 2002/0029409 | A1 * | 3/2002 | Coccia | 2/456 |
| 2003/0056282 | A1 * | 3/2003 | Coccia | 2/466 |
| 2005/0066423 | A1 * | 3/2005 | Hogan | 2/227 |
| 2005/0210570 | A1 * | 9/2005 | Garneau | 2/466 |

* cited by examiner

PROTECTIVE ELEMENT FOR CYCLIST PANTS

RELATED APPLICATION

This application is a National Stage filing of International Application No. PCT/EP2009/006395 filed Sep. 3, 2009 which is incorporated herein by reference.

The invention relates to a protective element for cyclist pants, which has a front and a rear protective region, which are connected with each other by means of a tapering, whereby the protective regions and the tapering each have one surface.

"Cyclist pants" in the sense of the present invention is to be understood as applying not just to pants, but also to cycling clothing for women and men that also contains an upper part. Such pants and dresses are used by both professional and non-professional cyclists, in both street and track cycling as well as during mountain biking. They are used to provide a protection for the body during long-term sitting on the narrow racing saddle of a sports bicycle. Because of the narrow saddle, body parts that are in direct contact with the saddle are subject to the highest local stresses, which can lead to severe injuries to the body parts involved if no protection measures are taken. For protection against such injuries, certain cyclist pants are known which are provided with protective cushions at the most highly stressed points in order to protect the highly stressed body points against pressure and friction.

In order to provide such protection against pressure and friction, it is known to sew or to glue protective elements into cyclist pants or racing suits manufactured for cyclists. Seat cushions, which are positioned in the area of the crotch of the pants, are used for this purpose. The cushion may consist of cushioned natural leather or of cushioned artificial leather; the use of gel cushions is also known.

The known protective elements have a friction-reducing and smooth surface. In order to achieve an additional reduction of friction, it is normal to lubricate the protective elements produced from natural leather before use. In the case of woven cushions, friction-reducing textiles are used. It is common to the protective elements that they have a very smooth surface, in order to keep the friction between the cushion and the skin of the user as low as possible.

The protective elements previously used have the following disadvantage, however: During cycling, sweat is formed because of the increased physical exertion. This formation of sweat also appears in the area of the protective elements in cyclist pants. The moisture present in the form of the sweat leads to a weakening of the skin of the cyclist, as is generally the case upon the contact of the skin with moisture. The mechanical resilience of the skin is reduced through the weakening of the skin. This brings about the danger of an injury to the skin by an increased friction, as the result of which the efficiency is reduced.

The invention is intended to provide a remedy for this. The task that forms the basis for the invention is that of providing a protective element for cyclist pants, which while leaving the dampening characteristics the same, prevents a weakening of the skin, even upon the accumulation of sweat. In accordance with the invention, this task is solved by a protective element, the surface of which has a three-dimensional structure.

A protective element for cyclist pants is provided by means of the invention, which makes a removal of sweat possible and thereby contributes to a lower stressing of the skin by moisture. As the result, the mechanical resilience of the skin is reduced less severely, so that the danger of injuries from friction is significantly reduced. The provision of a three-dimensional structure as a surface for protective elements for cyclist pants thereby stands in contrast to the previous solutions, which proceeded from the theory that the smoothest possible—and therefore two-dimensional—surface is best suited for protective elements, since the friction is held to a low level because of the smooth surface. It was not thereby taken into consideration, however, that the moisture has no possibility of escaping, so that a weakening of the skin is brought about by the moisture accumulating from the continuous stressing of the skin. Through the ongoing influence of the moisture on the skin, the mechanical resilience of the same is continuously reduced, so that the probability of injuries from friction becomes great. This effect is amplified by the use of greases in leather cushions, since the grease can lead to a sealing of the pores, so that the circulation of air is completely impeded.

In a further development of the invention, the structure is manufactured from a knitted fabric. This type of production makes a largely free configuration of the three-dimensional form possible. Through the varied formation of the knitted fabric, various structures, which have different characteristics, can consequently be brought about. In addition, the knitted fabric has a high elasticity, which contributes to an optimal adjustment of the protective element to the movements and the body.

Pockets and/or recesses are preferably formed in the structure. The pockets and/or recesses make an absorption of the sweat possible. At the same time, the pockets or recesses, respectively, are filled with air, so that an absorption of the sweat by the air, which results in evaporation, is brought about through the absorption of the moisture in the pockets and recesses filled with air. As the result, a removal of the moisture from the particularly stressed area is made possible.

In another further development of the invention, air channels are provided in the structure. The air channels likewise contribute to removing moisture from the areas that are particularly stressed by the accumulation of sweat, which leads to a greater reduction of the stressing of the skin by moisture.

Figure 2:
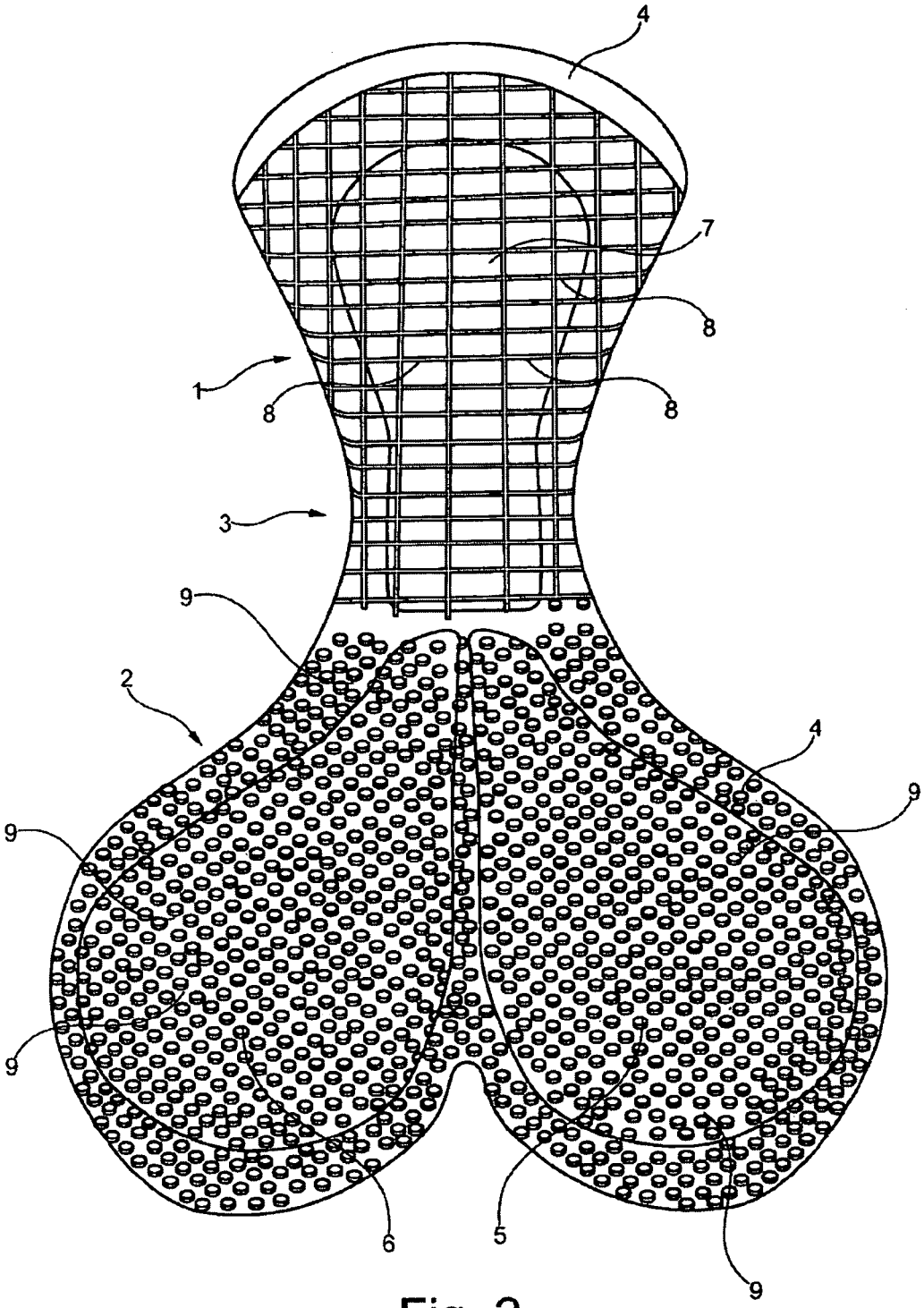
Figure 3:
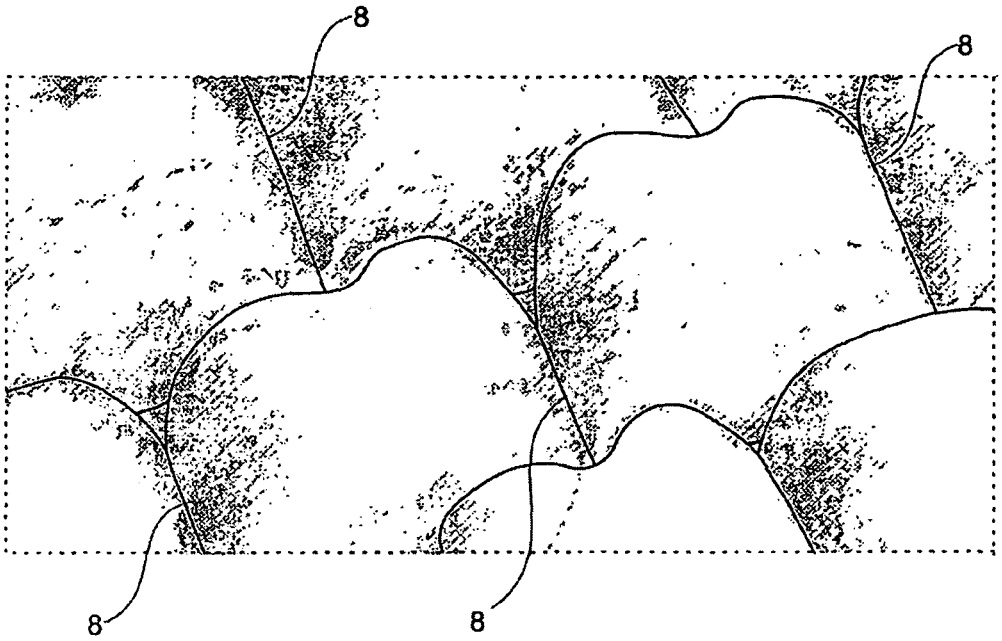
Figure 4:
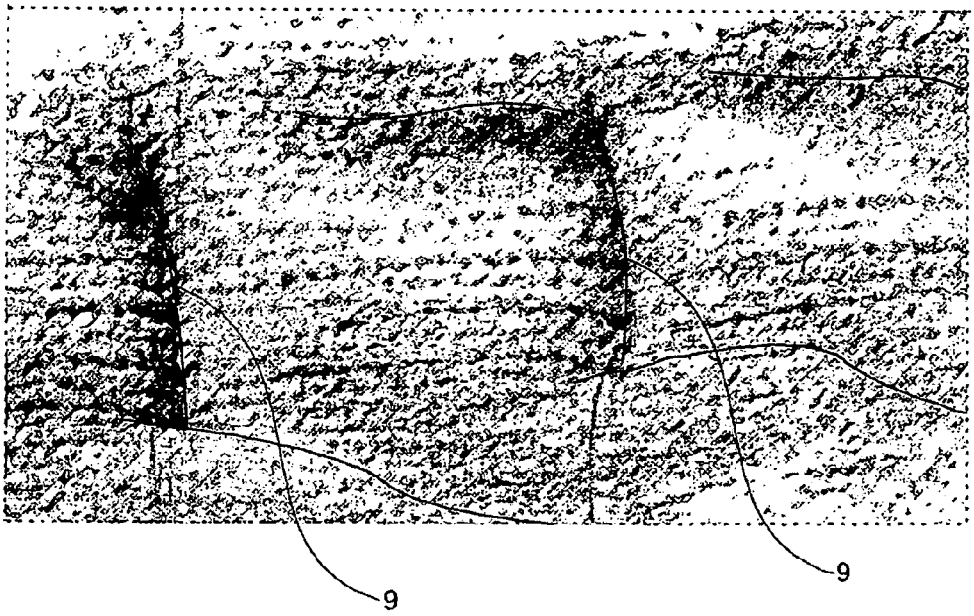
Figure 5:
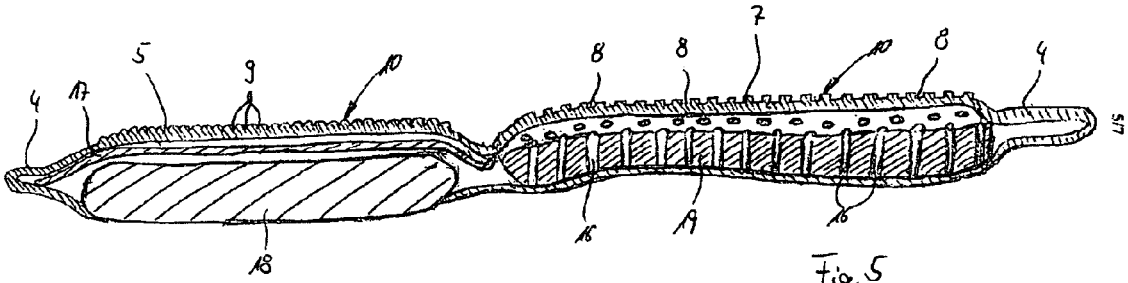
Figure 6:
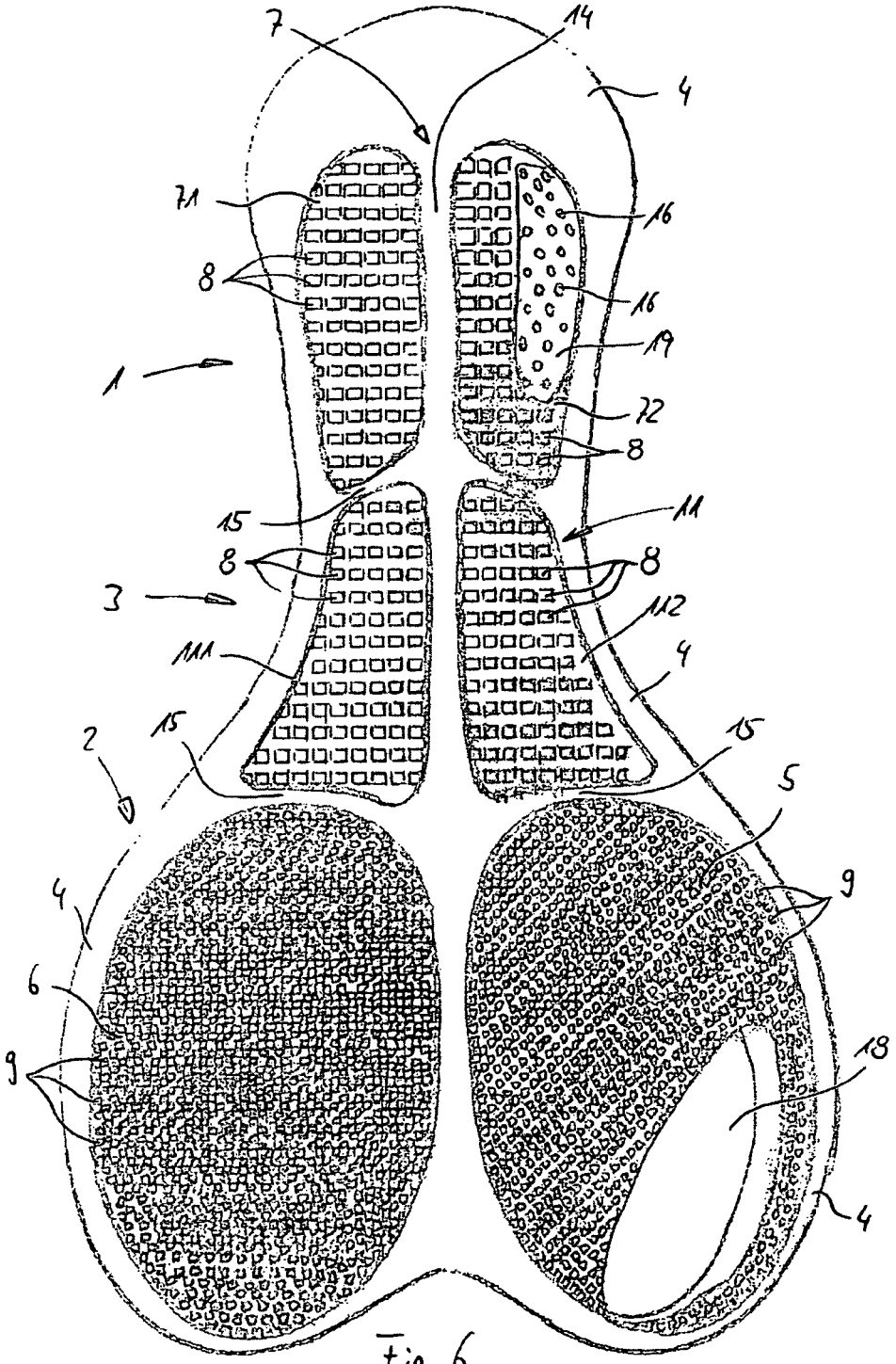
Figure 7:
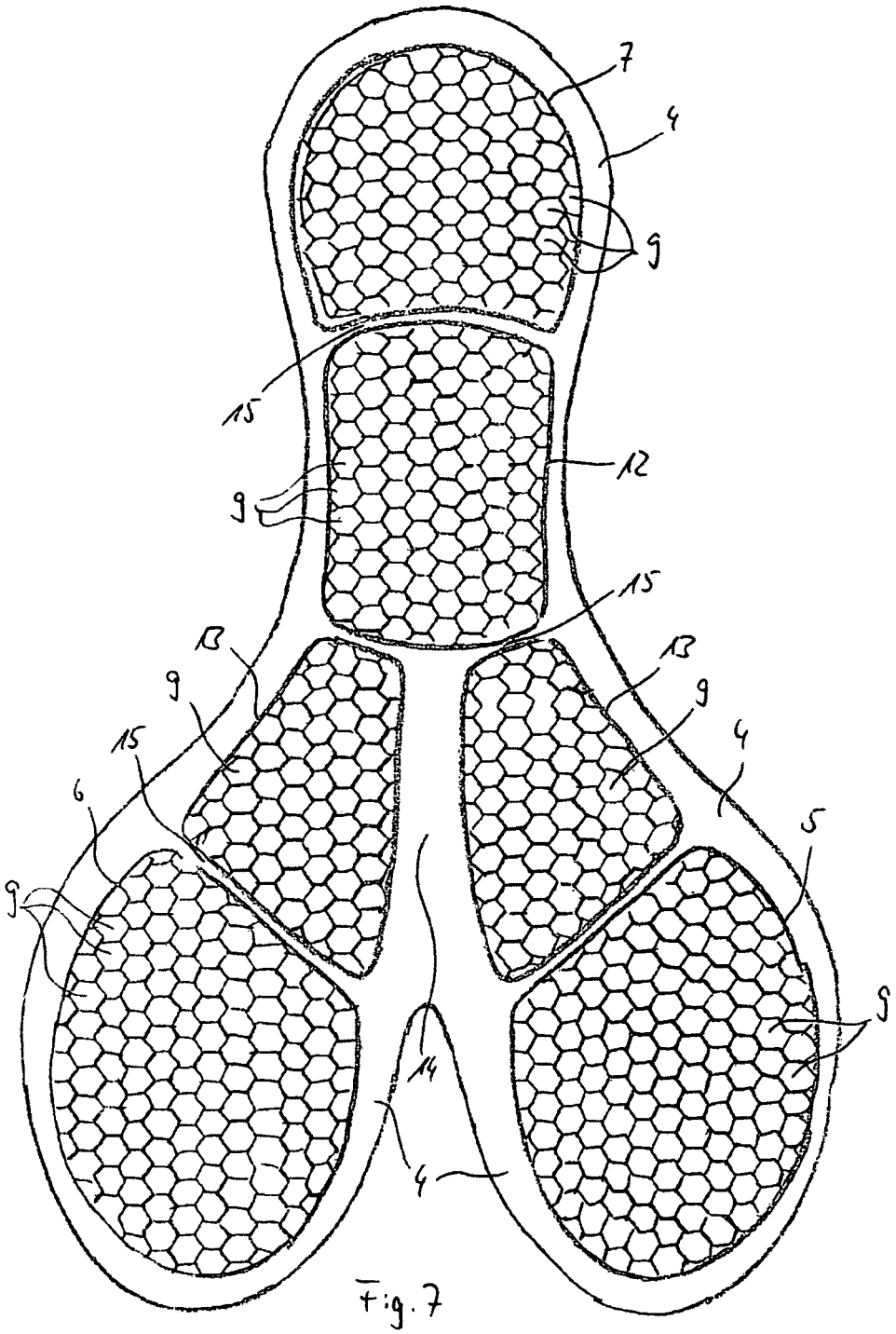

Other further developments and embodiments of the invention are presented in the remaining sub-claims. One embodiment of the invention is depicted in the diagrams and is described in the following in individual terms. The diagrams depict the following:

FIG. 1: The depiction of a protective element;

FIG. 2: The depiction of a protective element in another development;

FIG. 3: The sectional, enlarged, and perspective depiction of the three-dimensional structure of the surface in which the recesses are formed;

FIG. 4: The sectional, enlarged and perspective depiction of the three-dimensional structure of the surface in which the pockets are formed;

FIG. 5: The schematic depiction of a section through a protective element;

FIG. 6: The depiction of a protective element in an additional development in a depiction cut away in certain areas; and:

FIG. 7: The depiction of a protective element in an additional development.

The protective element for cyclist pants that is selected as an embodiment has a front protective region 1 and a rear protective region 2. The protective regions 1 and 2 are connected with each other by means of a tapering 3. The protective element is provided with an edge 4 on its circumference, at least in certain areas. The edge 4 serves for the attachment of the protective element to the cyclist pants—which are not depicted. The connection between the protective element and the cyclist pants can be brought about by means of sewing, gluing, melding, or the like.

Cushions 5, 6, and 7 filled with gel are provided in the protective element (FIGS. 1 and 2). In one modification of this embodiment, this may also involve foamed cushions, such as depicted in FIG. 5, for example. The cushions 5, 6, and 7 are formed anatomically and tailored to be ergonomic. They offer an effective damping of impacts, and make a uniform distribution of pressure possible. The form of the cushions 5, 6, and 7 depicted involves only one possible variant. The cushions 5, 6, and 7 can also have other forms, as is depicted in FIGS. 6 and 7.

In the embodiment in accordance with FIG. 6, for example, the cushion 7 is also provided in addition to the cushions 5 and 6, but this cushion, however, is constructed in a divided manner, as the result of which the cushion parts 71 and 72 are produced. Furthermore, a cushion 11 is additionally provided in the area of the tapering 3, which cushion is likewise constructed in a divided form, as the result of which the cushion parts 111 and 112 are produced. The cushions 5, 6, and 7 are also provided in the embodiment in accordance with FIG. 7. These, however, have a smaller surface in comparison with the other embodiments. The free space that is thereby formed between the cushions is, on the one hand, filled up in the area of the tapering 3 by a cushion 12 and is, on the other hand, filled up in the rear protective region 2 by two cushions 13. Through the divided design of the cushion 11, as well as the arrangement of the additional cushions 12 and 13, a longitudinal joint 14 and a transverse joint 15 are produced, which improve the mobility of the protective element and thereby increase the adjustability to the body.

The protective element, and thereby the protective regions 1 and 2, as well as the tapering 3, are provided with a surface 10 which, in the embodiments in accordance with FIGS. 1 and 2, encompasses the entire protective element on its side oriented towards the skin. In the embodiments in accordance with FIGS. 6 and 7, only the surface 10 is provided in the area of the cushions 5 to 7, and 11 to 13. The surface 10 has a three-dimensional structure, which is produced from a knitted fabric. Different threads can be used for the production of the knitted fabric. These preferably involve skin-friendly threads, which can additionally have bacteriostatic, non-allergenic, odor-inhibiting, and antistatic characteristics.

In the embodiment in accordance with FIG. 2, recesses 8, which extend up to the tapering 3, are formed in the structure of the protective region 1. In the embodiment in accordance with FIG. 6, the recesses 8 are provided on the cushions 7 and 11. The recesses 8 absorb the accumulating sweat, channel it, and rapidly transport it out from the perspiration-intensive front protective region 1. In the embodiment in accordance with FIG. 2, pockets 9, which overall have a honeycomb structure, are formed in the rear protective region 2. These extend into areas in the tapering 3. The pockets 9 are also present in the embodiments in accordance with FIGS. 6 and 7, but in modified form, however. In FIG. 6, the pockets 9 are provided on the cushions 5 and 6; in FIG. 7, all of the cushions are provided with a honeycomb structure forming the pockets 9. The pockets 9 contribute to a large-surface distribution of the pressure, and consequently increase the comfort. At the same time, the skin is back-ventilated by the pockets 9. Furthermore, the pockets 9 absorb sweat in a manner comparable to the recesses 8, and contribute to rapidly removing the same from the skin. The recesses 8, as well as the pockets 9, thus contribute to providing a dry feeling for the skin, as the result of which the mechanical characteristics of the skin in the affected area are not negatively influenced by moisture, so that the danger of injuries, particularly from friction, is distinctly reduced. In the embodiment in accordance with FIG. 1, this effect is brought about by means of a reticulated structure.

The cut through a protective element for cyclist pants depicted in FIG. 5 makes its construction clearer. The cushion 7 is evidently foamed in the front protective region 1, in contrast to which the cushion 5 depicted in the section is filled with gel. The filling with gel is provided by a so-called gel pad 18, which essentially has the form of the cushion 5. The form of the foamed cushion 7 is reproduced by a foam pad 19. Ventilation channels 16 are provided in the foamed cushion 7 or the foam pad 19, respectively. The ventilation channels 16 are oriented vertically. They serve for ventilation and aeration in the area of the protective element. In this way, the removal of the moisture that arises and an exchange with fresh air is additionally improved.

The three-dimensional structure of the surface 10 in the area of the cushions 5 and 7 is additionally depicted in FIG. 5. It is evident that elevations and depressions alternate on the surface 10, whereby the depressions form the recesses 8 or the pockets 9, as the case may be. This is also comparably shown in the remaining cushions 6 and 11 to 13. It can likewise be inferred from FIG. 5 that an intermediate layer 17 is positioned between the cushion 5 and the surface 10. The intermediate layer 17, on the one hand, has damping characteristics and, on the other hand, it promotes the dimensional stability of the protective element.

In the protective element in accordance with the invention, the three-dimensional structure, with its recesses 8 and pockets 9 formed therein and filled with air, leads to an "airy" formation of the protective element. A clearly improved climate control is achieved by means of the ventilation, which is significantly improved relative to the known state of the art by means of the protective elements. The climate control is additionally improved through the fact that movements are transmitted to the protective element during cycling. Through the alternating pressure on the protective element that results from the same, a pressure is exerted on the recesses 8 and the pockets 9, which are thereby deformed. A type of pump effect thereby arises from the air located in the recesses 8 and pockets 9. This leads to an accelerated supplying and removal of the air, and amplifies the cooling effect. At the same time, it brings about an accelerated removal of the moist air, through which the efficiency is increased. The stated effect is additionally increased through the provision of the ventilation channels 16, because, on the one hand, fresh air is thereby moved into the protective element from below and, on the other hand, moist air is removed through the ventilation channels 16 in an accelerated manner.

In addition, the recesses 8 and the pockets 9 offer the possibility for the user of the cycling pants to store the grease that is used. In contrast to the example of leather cushions, in which the use of grease can lead to a sealing of the pores, the three-dimensional structure in the protective element in accordance with the present invention is able to store the grease in the recesses 8 or pockets 9, as the case may be, without the ventilation and aeration function being lost, since the grease can seep into the recesses 8 or the pockets 9, as the case may be.

As a supplement to the embodiment, the possibility additionally exists for providing air channels—which are not depicted—within the structure, which make an additional provision and removal of air possible. The air channels can, on the one hand, be positioned directly underneath the surface 10 and can, on the other hand, be woven into the structure.

The invention claimed is:

1. A protective element for cyclist pants comprising:

a front protective region having a front surface and a rear protective region having a rear surface wherein a tapering region is located between the front protective region and the rear protective region;

the front protective region having at least one front cushion and the rear protective region having at least one rear cushion; and wherein only the front surface above the front cushion and only the rear surface above the rear cushion has a three-dimensional structure produced from a knitted fabric that has pockets or recesses wherein the recesses are formed in the structure or are air channels in the structure.

2. The protective element in accordance with claim 1 wherein the tapering region is adjoined to the front protective region and/or the rear protective region.

3. The protective element in accordance with claim 1 wherein the at least one front cushion and/or the at least one rear cushion is filled with gel.

4. The protective element in accordance with claim 1 wherein the front cushion or the rear cushion are composed of foam.

5. The protective element in accordance with claim 4 wherein the foam comprises ventilation channels.

6. The protective element of claim 1 further comprising an intermediate layer wherein the intermediate layer is below the front surface and/or the rear surface and above the at least one front cushion and/or the at least one rear cushion.

* * * * *